United States Patent [19]

Crawford et al.

[11] Patent Number: 4,560,120

[45] Date of Patent: Dec. 24, 1985

[54] SPIN STABILIZED IMPULSIVELY CONTROLLED MISSILE (SSICM)

[75] Inventors: James I. Crawford; W. Max Howell, both of Orlando, Fla.

[73] Assignee: The United States of America as represented by the Secretary of the Army, Washington, D.C.

[21] Appl. No.: 524,627

[22] Filed: Aug. 19, 1983

[51] Int. Cl.[4] ..... F42B 15/18

[52] U.S. Cl. ..... 244/3.22

[58] Field of Search ..... 244/3.22, 3.1

[56] References Cited

U.S. PATENT DOCUMENTS

| | | | |
|---|---|---|---|
| 3,984,071 | 10/1976 | Fleming | 244/3.22 X |
| 4,211,378 | 7/1980 | Crepin | 244/3.22 |
| 4,347,996 | 9/1982 | Grosso | 244/3.22 X |
| 4,370,716 | 1/1983 | Amieux | 244/3.22 X |
| 4,384,690 | 5/1983 | Brodersen | 244/3.22 |
| 4,408,735 | 10/1983 | Metz | 244/3.22 |

*Primary Examiner*—David H. Brown

*Attorney, Agent, or Firm*—John H. Raubitschek; Werten F. W. Bellamy; Robert C. Sims

[57] ABSTRACT

SSICM is a missile configuration which employs spin stabilization, nutational motion, and impulsive thrusting, and a body mounted passive or semiactive sensor to achieve very small miss distances against a high speed moving target. SSICM does not contain an autopilot, control surfaces, a control actuation system, nor sensor stabilization gimbals. SSICM spins at a rate sufficient to provide frequency separation between body motions and inertial target motion. Its impulsive thrusters provide near instantaneous changes in lateral velocity whereas conventional missiles require a significant time delay to achieve lateral acceleration.

1 Claim, 10 Drawing Figures

SPIN STABILIZED IMPULSIVELY CONTROLLED MISSILE (SSICM)

DEDICATORY CLAUSE

The invention described herein was made in the course of or under a contract or subcontract thereunder with the Government and may be manufactured, used, and licensed by or for the Government for governmental purposes without the payment to us of any royalties thereon.

BACKGROUND OF THE INVENTION

SSICM was conceived as a low cost non-nuclear ground to air interceptor of very high speed target such as offensive missiles. It was also conceived to achieve very small miss distances. The key feature that permits a small miss is the extremely fast maneuver response time. The fast response time is achieved by employing liquid pulse motors which produce a quantum change in lateral velocity in 0.004 to 0.008 seconds. The amplitude of the quantum velocity change is maximized by keeping the vehicle weight down. Weight has been minimized by the following techniques.

a. Spin stabilization eliminates the need for an autopilot, aerodynamic control surfaces, control surface actuators, control accelerometers, and associated power supplies.

b. The body mounted sensor eliminates the need for stabilization gimbals, stabilization gyros, resolvers, and associated structure and power supplies.

The SSICM concept arose out of a need for non-nuclear means to kill very high speed offensive missiles. Conventional approaches suffered from slow maneuver response because of their high weights. Because of their slow response it was necessary to predict ahead to determine guidance maneuvers, warhead aiming, and fuzing time. Accurate prediction required accurate tracking data which required high sensor accuracy at longer target ranges.

SSICM avoids these problems by maintaining its ability to respond to guidance errors all the way down to approximately 0.008 second to go. This ability to respond eliminates the need for predictions and also allows the sensor to be relatively inaccurate at the longer ranges.

DESCRIPTION OF THE BEST MODE AND PREFERRED EMBODIMENT

Figure 1:
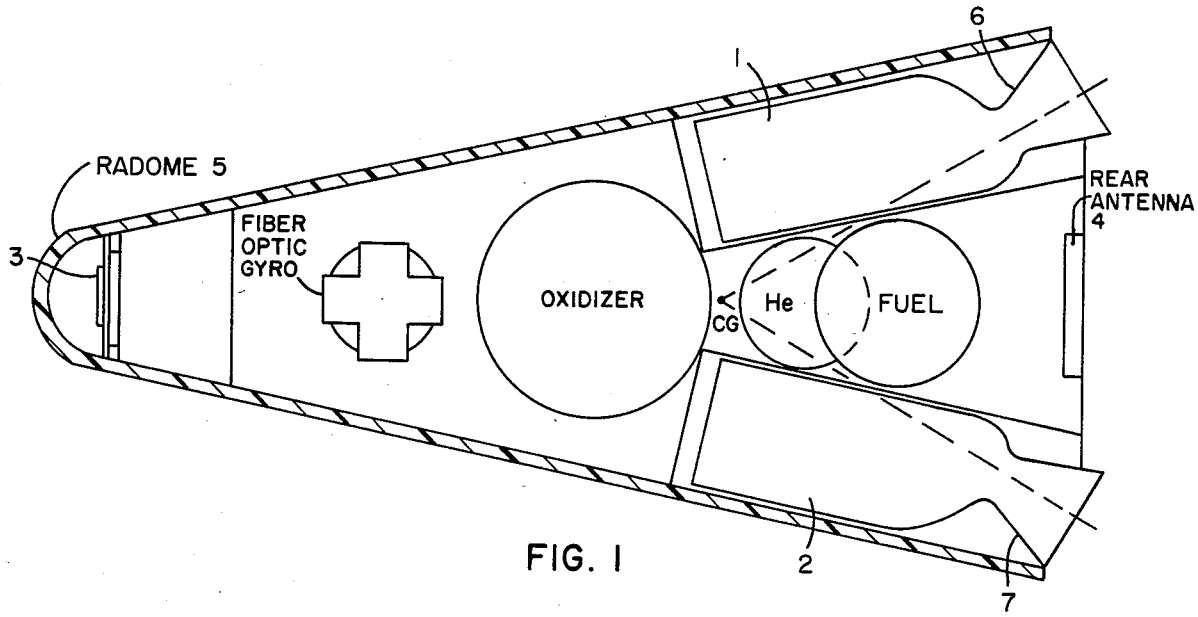
FIG. 1 is a based line configuration of the basic missile.
Figure 7:
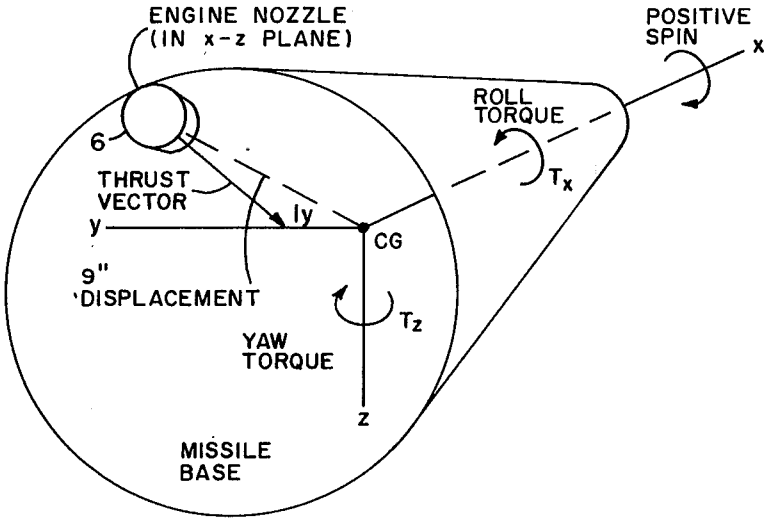
FIG. 7 is an illustration of the orientation of the pulse motors.

The baseline SSICM configuration is shown in FIGS. 1 and 7. There are two liquid pulse motors 1 and 2 located 180° apart in roll. The pulse motor nozzles 6 and 7 are canted 30 degrees to the missile centerline so that their line of thrust goes through the missile center of gravity (CG). This results in 50% of the thrust acting in the lateral direction and 86.6% acting in the axial direction. The missile cone angle is adjusted to prevent the canted motor plume from inducing excessive flow separation when a motor is fired. Some aerodynamic moment impulse from flow separation is tolerable depending on the application.

Figure 2A:
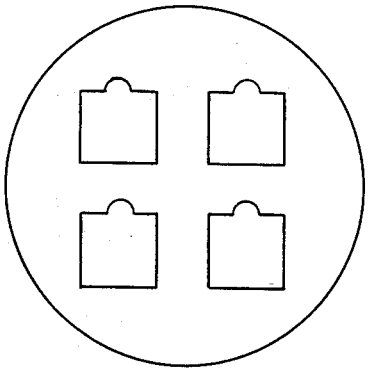
FIG. 2*a* and FIG. 2*b* illustrate the C-band antenna.
Figure 2B:
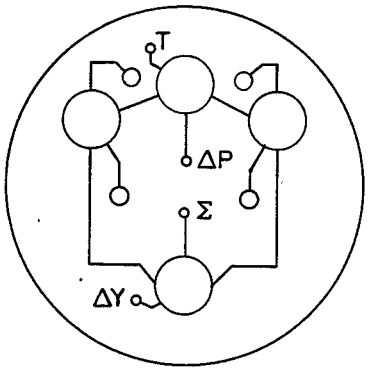
Figure 3A:
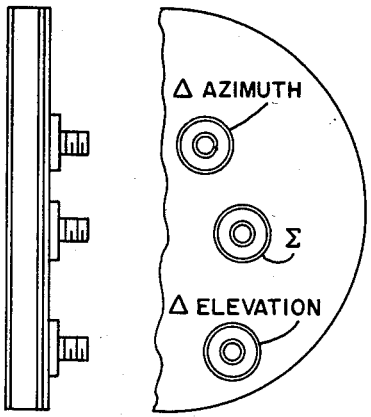
FIG. 3*a* and FIG. 3*b* illustrate the X-band antenna.
Figure 3B:
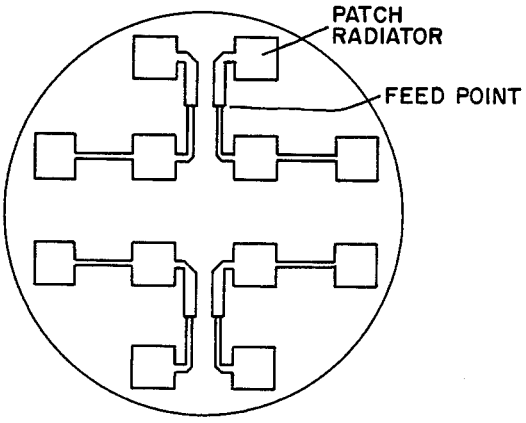

For semi-active RF guidance, the antenna 3 is a body mounted patch type as shown in FIG. 2. Standard 3 channel $\Sigma+\Delta$ monopulse processing is employed along with doppler tracking of both the illumination beam (via rear reference antenna 4) and the target reflections. This doppler tracking permits the use of a low band width receiver (FIG. 4) to help reject noise. The antenna beam is forward staring with a beamwidth dependent on the application. FIG. 2 shows an antenna with beamwidth ±30° at C band while the antenna of FIG. 3 has a beamwidth of ±15 degree at X band. The radome material 5 depends on the application.

The unique feature of SSICM is the combination of spinning with 1 a conical configuration, 2 canted motor nozzles, 3 pulse motors and 4 a body mounted sensor.

FIGS. 1 and 7 are an exagerated views of the SSICM configuration which emphasizes the orientation of the liquid pulse motors 1 and 2. Note that the engine nozzle is located at a radial distance of 9.0 inches behind the center of gravity at an angle ($\theta$) of 30 degrees with respect to the centerline and in the X-Z plane. However, the nozzle is canted such that the thrust action point intersects the missile Y-axis at a point 0.04 inches to the left of the CG. The primary effect of this orientation is that a 6000# thruster produces a 3000# component of thrust ($F_z$) in the Z direction, and a 17.32 ft-lb torque about the Z-axis ($T_z$, positive using the right hand rule). There is also a small component of force in the y-direction, and a small negative torque about the X-axis which reduces the spin rate by a neglible amount (0.01 Hz) with each thruster firing. This orientation was chosen to satisfy the relationship:

$$\Delta V/V=\Delta H/H \tag{1}$$

where V is the missile velocity, ΔV is the change in velocity, H is the angular momentum, and ΔH is the change in angular momentum for each thruster firing. The change in missile velocity can be approximated by:

$$\Delta V=F\sin\theta\Delta t/m \tag{2}$$

where F is the thrust, $\theta$ is the thruster angle with respect to the missile centerline, Δt is the action time and m is the missile mass. The total angular momentum H can be approximated by:

$$H=PIxx \tag{3}$$

where P is the spin rate and Ixx is the missile moment of inertia about its X-axis (centerline). The change in angular momentum is approximately:

$$\Delta H=F\cos\theta ly\Delta t \tag{4}$$

where ly is the thruster offset distance from the center of gravity along the y-axis. Substituting expressions (2) through (4) into equation (1) and solving for ly we have:

$$ly=PIxx\tan\theta/(mV)$$

Evaluating for P=60 Hz, Ixx=350 lb-in$^2$, $\theta=30°$, W=40 lbs, and V=4000 fps we have:

$$ly = \frac{2\pi(60)\,(350)\tan 30°}{(40)\,(12)\,(4000)} = .04 \text{ inches.}$$

Similar relationships hold for the other thrusters whether two or four are employed.

The basic SSICM concept assumed that the missile is spun up to 60 Hz by its booster, or by a separate spin package prior to endgame. The spin rate does decrease due to roll jet damping and the negative roll torque generated with each thruster firing. However, by virtue of the roll reference system, good guidance system performance can be maintained over a wide range of spin rate.

The detailed six degree of freedom endgame simulation demonstrated good probability of hit performance even when spin rate dropped below 50 Hz. In any event, the 6000 lb thrusters are not used to maintain spin rate.

An alternate approach would be to use a set of smaller thrusters on the base to change the angular momentum vector according to equation number (1), and to maintain the spin rate.

Figure 4:
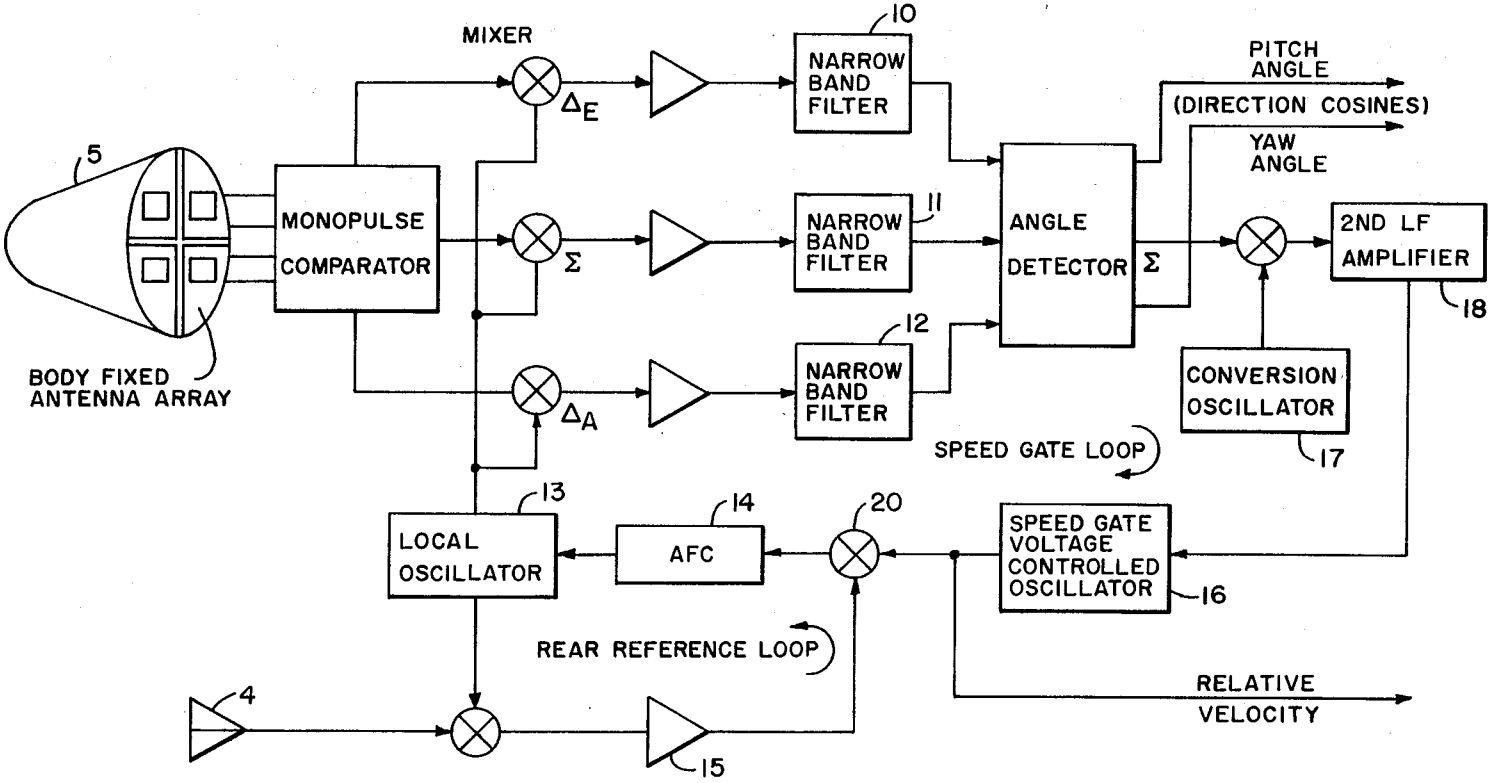
FIG. 4 is a block diagram of the receiver of the present invention.

FIG. 4 shows a functional presentation of the SSICM semiactive continuous wave (CW) radar seeker. This seeker or sensor is one of several elements required to control the flight path of the missile. The sensor itself is well known in the art and can be functionally identical to HAWK I. The purpose of the sensor is to provide the missile guidance computer with two signals representing the pitch and yaw bearing angles of the target. These signals must contain a minimum amount of superimposed noise as the guidance system is very susceptable to noise.

Before discussing the manner in which the sensor derives the target bearing angles the portions of FIG. 1 devoted to noise reduction will be described. These are shown in FIG. 4 by blocks 10–18 and rear antenna 4. The noise output of the sensor, like any receiver, increases with receiver bandwidth. Conversely, the noise output can be minimized by minimizing the receiver bandwidth, this is the reason for the "Narrow Band Filters" 10 and 12. The first step in minimizing the receiver bandwidth is to introduce a frequency tracking loop such as the "speed gate loop" 16. This loop dynamically tracks the variations in received frequency due to such things as Doppler shifts, and transmitter frequency drift. It keeps the center frequency of the receiver pass band equal to the received frequency except for dynamic errors in the tracking loop. The receiver bandwidth then only needs sufficient width to accommodate the bias and dynamic errors in the tracking loop. The 1000 Hz bandwidth was used in SSICM studies but was never optimized. Optimizing (minimum bandwidth) of the filter is application peculiar, requiring detailed knowledge of the application parameters, however, the principle of employing a frequency tracking loop and minimum bandwidth filter remain the same regardless of application. The frequency tracking loop 16 or "speed gate loop" produces a variable frequency output signal which when mixed by mixer 20 with the variable frequency target return signal produces a nearly constant intermediate frequency (IF) for signal processing purposes. Other than providing a nearly constant IF frequency, the speed gate loop contributes nothing to the calculation of the target bearing angles, consequently, the speed gate loop functions have been removed for discussion of the angle derivation scheme. As an aside, the speed gate loop does produce an output signal proportional to the SSICM/target closing velocity which can be employed to discriminate.

Figure 5:
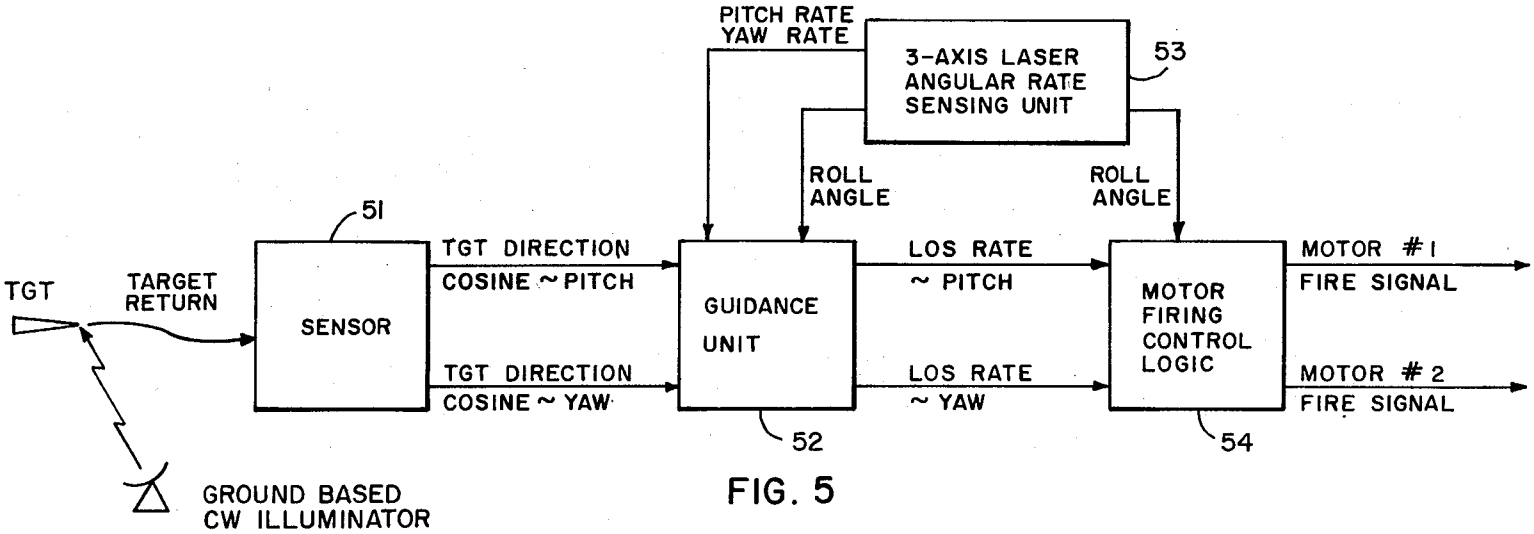
FIG. 5 is a block diagram illustrating the basic system.
Figure 6:
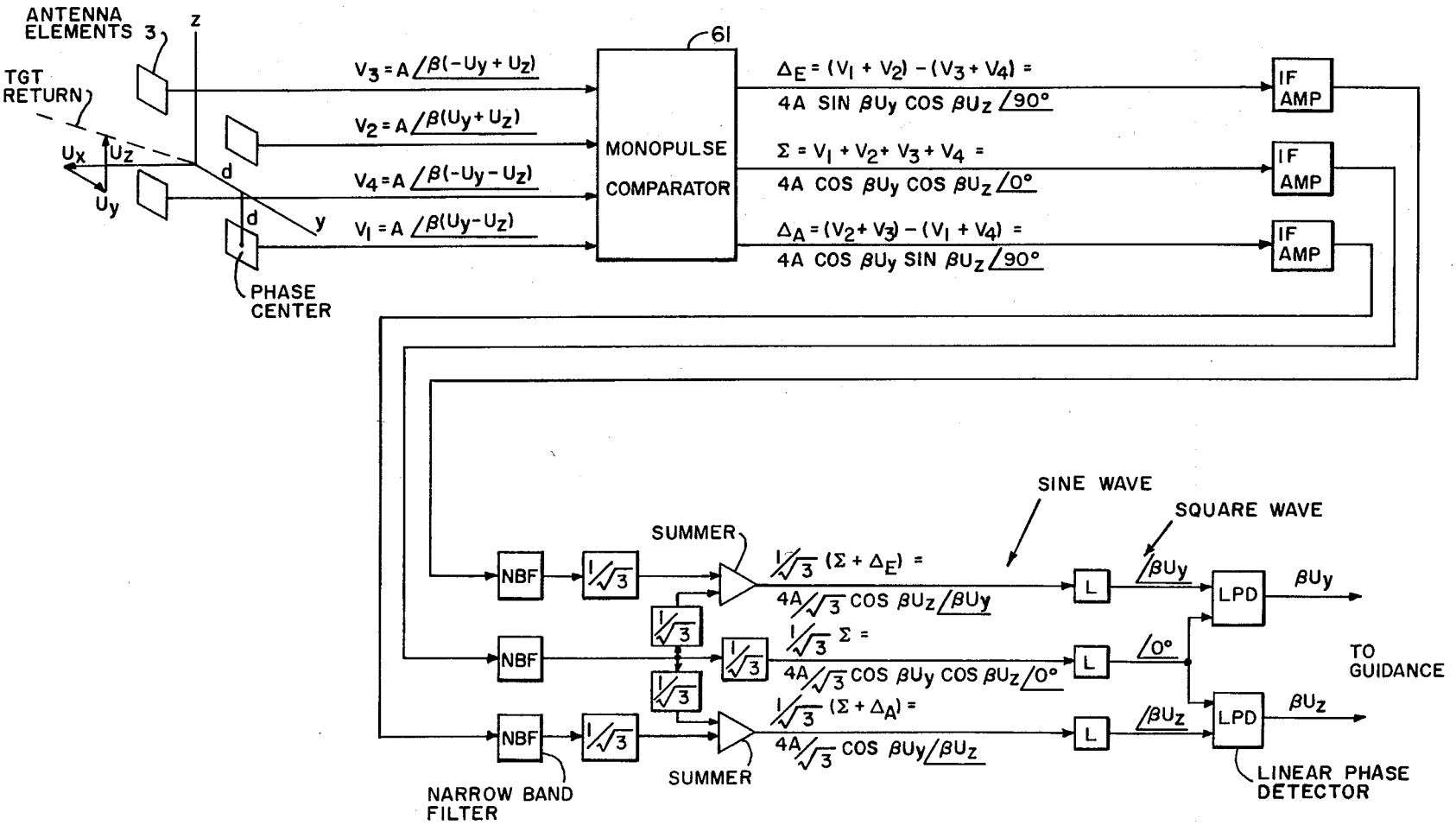
FIG. 6 is a block diagram illustrating the missile sensor system.
Figure 8:
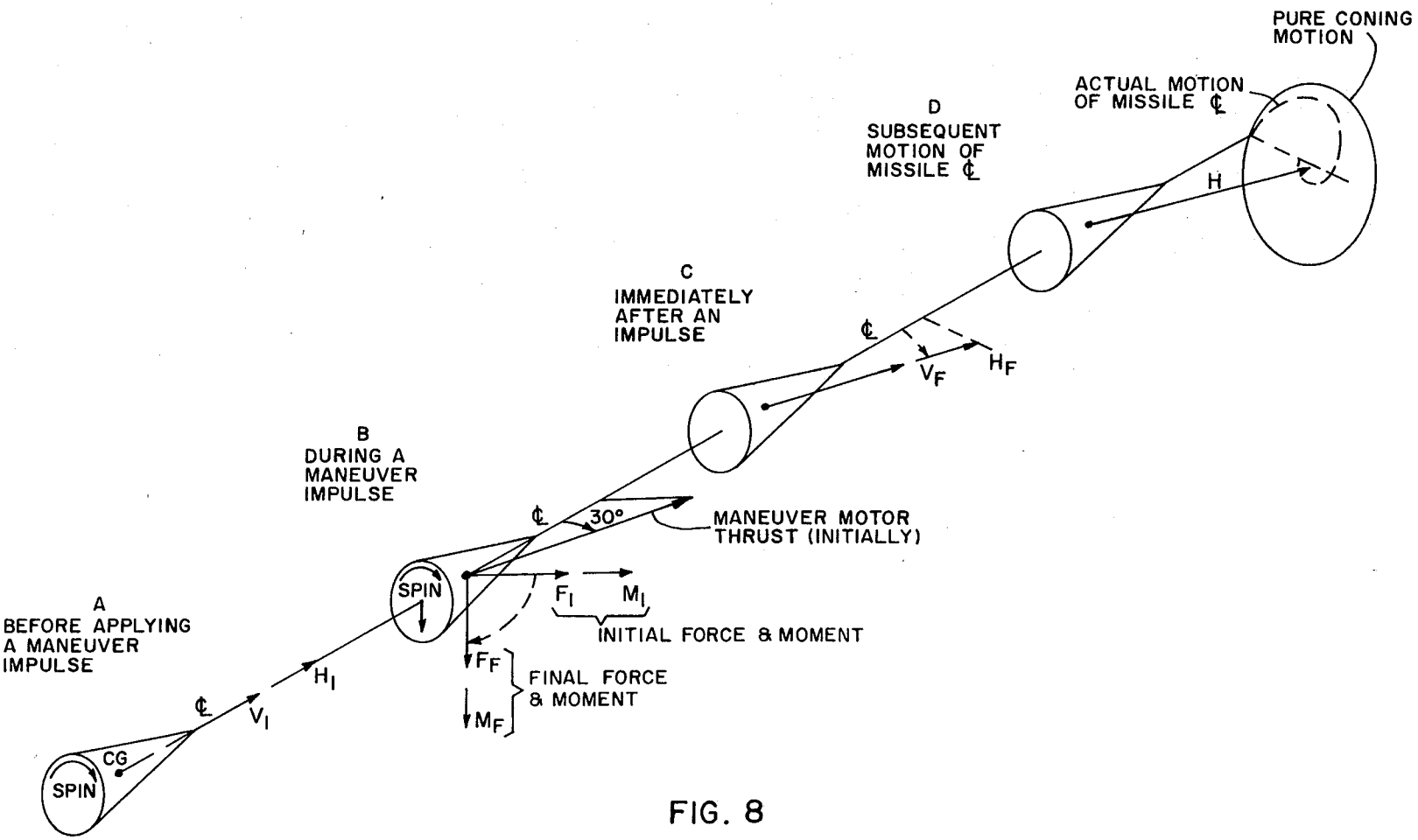
FIG. 8 shows movements of the missile.

FIGS. 5 and 6 are functional block diagrams of the angle sensing portions of the SSICM receiver which is a standard three channel "sum-plus-delta ($\Sigma+\Delta$) monopulse receiver very similar to the HAWK receiver. FIG. 6 shows that the electrical phase angles of the four independent antenna signals are dependent on the target direction cosines. It also shows how the antenna outputs are processed to extract the target direction cosines. Any of the known monopulse comparators can be used for comparator 61. The first step in this process is the formation of the pitch difference signal ($\Delta p$), the yaw difference signal ($\Delta y$), and the sum signal ($\Sigma$). This is done by the "Monopulse Comparator" 61 which is a standard passive RF device available from many sources. The arithmatic performed in the "Monopulse Comparator" and in the "Angle Detector" are shown. The specific circuit design or implementation of these devices is not important as long as they perform the indicated functions. Therefore, any of the well known circuits can be used. Note that the outputs of the sensor are the Y and Z direction cosines of the target line-of-sight expressed in missile (SSICM) body coordinates. These LOS direction cosines are differntiated and filtered in the guidance section to device appropriate maneuver commands.

The guidance section 52 in FIG. 5 utilizes the sensor 51 outputs and performs computations to derive an estimate of the targets inertial line of sight rate components in non-spinning body coordinates. Since SSICM spins and employs a body fixed seeker, the seeker outputs contain large oscillations at the spin frequency (baseline=60 Hz) and small amplitude oscillations at the nutation (baseline=15 Hz) frequency. The angular rates of these two unwanted signals masks the true line of sight rate signal to a very high degree. The guidance system is able to extract the true line of sight rate because of frequency separation and also by utilizing an adaptive feedback loop 53 that compensates for the seeker detector curve shape uncertainty.

The output of the guidance system 52 is two components of the true inertial line of sight rate in non-rolling missile coordinates. From these two components the desired roll orientation of the corrective maneuver thrust is calculated. The actual roll orientation of the two pulse motors is compared to the desired roll and the appropriate motor is fired by motor firing control logic 54 provided the line of sight rate is above same threshold value. The motors are pulse types and each pulse lasts for $\frac{1}{4}$ revolution of the missile. The pulses are initiated $\frac{1}{8}$ revolution beyond the desired angle thus averaging out to the desired direction. Each motor firing will turn the SSICM flight path by an incremental amount eventually leading to a collision with the target.

As the motors are fired to turn the flight path it is also desirable to reorient the attitude of the missile to coincide with the velocity vector. Otherwise an angle of attack builds up in a sense that causes lift opposing the impulse maneuver and causing unwanted aerodynamic moments on the airframe. SSICM attitude reorientation is achieved in a unique and clever way by utilizing the well known free body angular motions (nutation) of spinning bodies of revolution. As illustrated in FIG. 6 an impulsive torque is applied to the SSICM simultaneously with the impulsive force. The ratio of torque to force is designed so that the angular momentum vector is rotated incrementally through the same angle as the velocity vector. This gives the before and after relationships shown in FIG. 6. After both velocity and angular momentum vectors have been rotated, C the spin axis of the SSICM will nutate (or cone) about the new angular momentum vector. In the absence of aerodynamic moments this nutational motion would be a pure coning motion, whereas, with aero moments it will become a rosette centered in the new angular momentum vector. Aerodynamic damping tends to cause an inwardly spiraling motion with nutation eventually ceasing with spin axis (longitudinal missile axis) and angular momentum vector coinciding. It is not necessary for the nutational motion to cease or decay to some threshold value between maneuver pulses, in fact the guidance system works best in the presence of nutation because it is used somewhat like a dither signal to drive the adaptive loop referenced earlier.

The torque applied simultaneously with the force can be implemented in any convenient manner, however, calibration is easiest if hot gases are bled from the force pulse motor and exhausted at the missile base through a laterally aimed small nozzle. No valving is required and exact synchronizing is inherent.

The novel aspects of SSICM are:

1. Small misses are achieved by impulsive maneuvering combined with a conventional sensor rather than conventional maneuvering and a precision sensor.

2. The simultaneous impulsive change in both angular momentum and translational velocity vectors prevents build up of angle of attack which would cause (a) lift in unwanted and unknown directions (b) wandering of the angular momentum vector (c) precessional motion that may be in the guidance system pass band and (d) drag.

3. Impulsive maneuvering permits course changes at very close ranges where the sensor output is very sensitive to non-collision conditions and thermal noise is negligible.

4. High spin and nutational frequencies makes filtering of the body motions possible. The high nutational frequency makes adaptive channel balancing and seeker calibration possible.

5. The use of lateral thrust for maneuvering instead of aerodynamic lift gives a precise and known guidance gain which is necessary for achieving consistent small misses over a range of intercept conditions.

The objectives "body mounted" refer to the fact that the antenna is rigidly attached to the missile structure as opposed to the usual technique of mounting the antenna on gimbals so that it can be pointed independently of the missile attitude. Body mounting saves size, weight, and cost but usually does not work well because missile body motions are coupled into the target motions and the two become indistinguishable by the guidance computer. The ability of SSICM to distinguish between missile body motions and target motions is one of its most unique features.

We claim:

1. A method for guiding a missile to a target comprising the steps of spinning said missile so as to provide spin stabilization, utilizing nutational motions of said missile for guidance information, using impulse thrusting which is offset from a center of gravity of said missile for guiding and rotating said missle, spinning the missile at a rate sufficient to provide frequency separation between missile body motion and inertial target motion, utilization filters to separate the target motions from missile body motions, providing impulse thrust with near instantaneous change in lateral velocities, utilizing lateral thrust for maneuvering so as to give a known guidance gain for achieving consistent small misses over a range of intercept conditions, and providing simultaneous impulsive changes in both angular momentum and translational velocity vectors.

* * * * *